US006303001B1

(12) United States Patent
Grossmann et al.

(10) Patent No.: US 6,303,001 B1
(45) Date of Patent: Oct. 16, 2001

(54) PROCESS FOR IMPROVING THE SHRINKAGE CROSS DIRECTION PROFILE AND PAPER HAVING AN IMPROVED CROSS

(75) Inventors: Udo Grossmann, Heidenheim (DE); Guenter Halmschlager, Krems (AT); Erich Brunnauer; Alexander Wassermann, both of Vienna (AT); Eduard Bachler, St. Pölten (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/401,952

(22) Filed: Sep. 23, 1999

(30) Foreign Application Priority Data

Sep. 24, 1998 (DE) ..... 198 43 729

(51) Int. Cl.[7] ..... D21F 11/00

(52) U.S. Cl. ..... 162/183; 162/198; 162/DIG. 11; 162/164.1; 162/164.2; 162/168.1

(58) Field of Search ..... 162/183, 198, 162/DIG. 11, 164.11, 164.2, 168.1

(56) References Cited

U.S. PATENT DOCUMENTS 5,401,363 * 3/1995 Begemann ..... 162/164.6
5,658,432 * 8/1997 Heaven ..... 162/198
5,707,495 1/1998 Heinzmann et al. .
5,885,420 3/1999 Heinzmann et al. .

FOREIGN PATENT DOCUMENTS 2210200 5/1997 (CA) .
3715551 12/1988 (DE) .
3741603 6/1989 (DE) .
4008282 9/1991 (DE) .

(List continued on next page.)

OTHER PUBLICATIONS

Ulrich Begemann, "Stoffdichtequerprofilregelung: Voraussetzungen für eine erfolgreiche Installation". *Das Papier 6*, pp. 344–348 (1998).

H. Schoen, "Wechselwirkung zwichen Querprofilen am Beispiel einer Spezialpapiermaschine". *Wochenblatt für Papierfabrikation 6*, pp. 242–246 (1995).

(List continued on next page.)

*Primary Examiner*—Stanley S. Silverman
*Assistant Examiner*—Mark Halpern
(74) *Attorney, Agent, or Firm*—Greenblum & Bernstein P.L.C.

(57) ABSTRACT

Process for homogenizing the property cross direction profile of a continuous web made of paper or cardboard and a paper machine that is suitable for carrying out the above-mentioned process. The process is characterized in that the shrinkage cross direction profile of the material web is homogenized during its manufacturing process by controlling the local composition of the stock suspension sectionally across the width by changing the proportions of components that have different shrinkage behaviors. The paper machine includes an approach flow system having at least two regions that produce different stock suspensions with fiber mixtures that have different shrinkage behaviors. The stock suspension supplies from the approach flow system to the headbox have at least two branches for the at least two different stock suspensions. Near the headbox, a plurality of sectional mixing points are provided, which combine the stock suspensions that have different shrinkage behaviors. Paper is produced from the process and device.

21 Claims, 5 Drawing Sheets

FOREIGN PATENT DOCUMENTS

| | | |
|---|---|---|
| 4019593 | 1/1992 | (DE) . |
| 4211291 | 10/1993 | (DE) . |
| 4422907 | 1/1996 | (DE) . |
| 19542448 | 5/1997 | (DE) . |
| 4239845 | 12/1998 | (DE) . |
| 565923 | 2/1996 | (EP) . |
| 96/19615 | 6/1996 | (WO) . |

OTHER PUBLICATIONS

A. Gräser, "Querprofilregelung–Regelstrategien, erreichbare Regelgüte und Einflussfaktoren auf das Regelergebnis". *Wochenblatt für Papierfabrikation 8*, pp. 352–360 (1995).

H. Prasst et al., "Lokale Querschrumpfung von Papierbahnen". *Das Papier Heft 4*, pp. 151–161 (1995).

M. Heaven et al., "Integrated tool for intelligent identification od CD process alignment, shrinkage and dynamics". *Pulp & Paper Canada Heft 2*, pp. 40–44 (1998).

* cited by examiner

PROCESS FOR IMPROVING THE SHRINKAGE CROSS DIRECTION PROFILE AND PAPER HAVING AN IMPROVED CROSS

CROSS-REFERENCE TO RELATED APPLICATIONS

The present application claims priority Linder 35 U.S.C. §119 of German Patent Application No. 198 43 729.3, filed on Sep. 24, 1998, the disclosure of which is expressly incorporated by reference herein in its entirety.

BACKGROUND OF THE INVENTION

1. Field of the Invention

The present invention relates to a process for producing a uniform cross direction profile of a continuous web of paper or cardboard. More particularly, the present invention relates to a paper machine suitable for executing the process mentioned above and the resulting paper.

2. Discussion of Background Information

German patent publication No. DE 37 15 551 A1 discloses a process for reducing the fluttering of the web edges of a paper web as well as a paper machine for executing this process. This patent publication proposes using a stock suspension with a higher strength potential in the edge region of the paper web to be manufactured than in the rest of the web width region. With regard to the paper machine, the publication discloses providing additional lines in the headbox to supply the stock suspension into the side regions of the headbox.

Despite this lateral supply of different stock suspensions to the edge regions or different additives to the stock suspension, varying shrinkage occurs across the width of the web. As a rule, the edges shrink more than the central regions of the material web due to additional processing in the paper machine. However, different shrinkage behavior across the entire width of the material web can also result from different drying speeds or from different processing across the entire material web. Consequently, the problem of uneven shrinkage is not limited to the edges of the web.

SUMMARY OF THE INVENTION

It is an object of the present invention to provide a process for the manufacture of a continuous web, e.g. paper or cardboard web, which produces a homogenization of the shrinkage behavior of the web across the entire width. Another object of the invention is to produce a paper machine for executing the process.

The inventors have recognized that, based on the different shrinkage behavior of the web, e.g. paper or cardborad web, across its width, criteria necessary for high paper quality, for example, surface roughness or strength values, etc., also change across the width, depending on the shrinkage cross direction profile. Therefore, the homogenization of the shrinkage behavior of the paper web should homogenize not only the shrinkage behavior, but also the correlating property parameters of the paper across the entire width of the web. Consequently, the present invention improves the process for manufacturing a paper or cardboard web to the extent that the shrinkage cross direction profile of the web is homogenized during its manufacturing process by influencing the local composition of the stock suspension sectionally across the width by using components having different shrinkage behavior. When the homogenization is achieved, a reduction of the differences in the properties of the material web across the entire width, particularly on its surface, e.g., roughness, results.

According to an embodiment of the process, the shrinkage of a sectional region is intensified by increasing the number of fibers and/or other materials that have an increased shrinkage tendency or, in another embodiment, replacing fibers and/or other materials that have a lower shrinkage tendency in the "normal" mixture of the stock suspension with fibers and/or other materials that have an increased shrinkage tendency.

Reduced shrinkage of a particular section can be achieved in accordance with another embodiment by adding extra fibers and/or other materials that have a reduced shrinkage tendency in this section, or that the "normal" fiber mixture is replaced by a fiber mixture having a reduced shrinkage tendency. The same applies in the reverse for an increase in shrinkage.

Preferably, metering of the desired fibers and/or other shrinkage-influencing materials occurs in the headbox. In terms of the possibilities for metering or admixtures of stock suspensions that have different fiber properties, reference is made to Applicant's earlier German patent applications, DE 37 41 603 A1, DE 40 19 593 A1, DE 44 22 907 A1, DE 42 37 304 A1, and DE 42 11 291 A1, the disclosures of which are incorporated herein by reference in their entireties. With regard to the cited materials, particular emphasis is placed on the fact that possible basis weight changes, which could be produced through the metering of particular stock suspensions, etc., can be compensated for by a regulation mechanism in the known sectioned headboxes, which are supplied with stock suspensions having different concentrations and are sectionally controlled. These cited materials also disclose in detail how the supply of stock suspension having different properties to the headbox can be executed and how the basis weight cross direction profile of the material web can be kept uniform.

According to an improvement of the process, in order to achieve or maintain a desired cross direction profile, in the approach flow system of the paper machine or cardboard machine, at least two stock suspension streams are produced, with fibers that have different shrinkage behaviors and/or with other shrinkage-influencing materials, and close to or in the headbox, the shrinkage of the material web is balanced across the machine width by sectionally mixing at least two stock suspension streams with fibers that have different shrinkage tendencies, while the basis weight cross direction profile and/or the fiber orientation cross direction profile is/are influenced by means of sectionally metering white water flow so that the desired basis weight profiles are maintained or achieved.

According to an aspect of the present invention, a process is provided for homogenizing the property cross direction profile of a continuous material web. The process includes producing at least one machine width stock suspension layer on a wire or between two wires; controlling the local composition of the stock suspension sectionally across the width by changing the proportions of components with different shrinkage behaviors so that the shrinkage cross direction profile of the material web is homogenized during its manufacturing process; and draining, pressing, and drying the material web produced from the stock suspension layer.

The process may also include increasing supply of fibers and/or other materials having an increased shrinkage tendency to produce an intensification of the shrinkage of a sectional region. Alternatively, the process includes replacing fibers with a reduced shrinkage tendency with fibers and/or other materials having an increased shrinkage tendency to produce an intensification of the shrinkage of a sectional region. Alternatively, the process includes increasing a supply of fibers and/or other materials having a reduced shrinkage tendency to reduce the shrinkage of a sectional region. Alternatively, the process includes replacing fibers having an increased shrinkage tendency with fibers and/or other materials having a reduced shrinkage tendency to reduce the shrinkage of a sectional region.

The process may also include metering desired fibers and/or other materials in a headbox and/or in a wet section. Alternatively, the process may also include producing, in an approach flow system of the paper or cardboard machine, at least two stock suspension streams with fibers and/or other materials having different shrinkage behaviors; sectionally mixing at least two stock suspension streams with fibers and/or other materials that have different shrinkage tendencies in the region of the headbox so that the shrinkage of the material web across the machine width is balanced; and sectionally metering dilution water to control a basis weight cross direction profile and/or the fiber orientation cross direction profile.

According to another embodiment, long fibers are used as the fibers with an increased shrinkage behavior, and short fibers are used as the fibers with a reduced shrinkage behavior. Another variant, or one that can be additionally executed, is comprised in that highly re-pulped fibers are used as the fibers with increased shrinkage behavior, and slightly re-pulped fibers are used as the fibers with a low shrinkage behavior. Moreover, additionally or alternatively, there is the possibility of using fibers prone to increased shrinkage due to a higher degree of beating, or prone to decreased shrinkage due to a lower degree of beating.

Likewise, other materials can be used to influence the shrinkage, for example, encouraging it (CMC= carboxymethylcellulose) or hindering it with artificial resins, and /or wet strength additives. Adding fibers or fiber mixtures not derived from wood, e.g., plastic fibers, is another possibility.

According to another object, a paper machine includes an approach flow system, a headbox with at least one stock suspension supply from the approach flow system, a wet section, a press section, and a drying section. The approach flow system has at least two regions that produce different stock suspensions with fiber mixtures having different shrinkage behaviors. The stock suspension supplied from the approach flow system to the headbox have at least two branches for the at least two different stock suspensions, and near the headbox, a plurality of sectional mixing points are provided to combine the stock suspensions having different shrinkage properties. As discussed above, the different fiber mixtures for the stock suspension can be produced from fibrous material with either longer or shorter fibers, and/or more or less re-pulped fibers, and/or more or less beaten fibers and/or shrinkageinfluencing materials. Depending on their processing and/or structure and/or their parent material, these fibers produce a different shrinkage behavior, enabling uniform shrinkage behavior of the material web across the entire web width.

According to another aspect of the present invention, a process controls the shrinkage cross direction profile of a continuous paper or cardboard web. The process includes calculating the shrinkage cross direction profile by means of on-line mapping of the basis weight cross direction profile, determining control variables for adapting the shrinkage in M sections across the machine width in conjunction with a reference profile for the shrinkage, and operating actuators for adapting the shrinkage cross direction profile. The process also includes determining control variables for adapting the basis weight in N sections across the machine width in conjunction with a reference profile for the basis weight.

With regard to the intrinsically known on-line mapping, reference is made to the article "Voraussetzungen fuir eine erfolgreiche Installation" [Prerequisites for a Successful Installation] in "Das Papier", 6/1998, 344–354, in particular chapter 6, the disclaimer of which is incorporated herein by reference in its entirety.

Alternatively to the mathematical determination of the shrinkage profile, the process includes measuring a value that correlates to the shrinkage, calculating the shrinkage cross direction profile through correlation between the measured value and the shrinkage, determining control variables for influencing the shrinkage in M sections across the machine width in conjunction with a reference profile for the shrinkage, and operating actuators for adapting the shrinkage cross direction profile.

In addition, there is also the possibility of combining the above-mentioned processes and thus carrying out the following process steps: calculating the shrinkage cross direction profile by on-line mapping of the basis weight cross direction profile, and additionally measuring a value that correlates to the shrinkage, and calculating the shrinkage cross direction profile through correlation between the measured value and the shrinkage, determining a weighted shrinkage cross direction profile from the measured shrinkage cross direction profile and the calculated shrinkage cross direction profile, determining control variables for influencing the shrinkage in M sections across the machine width in conjunction with a reference profile for the shrinkage, and operating actuators for adapting the shrinkage cross direction profile.

It should be emphasized that the above-mentioned process can be carried out with a headbox that controls dilution water as well as with a headbox that has an adjustable aperture. With a dilution water-regulated headbox, the actuators for controlling the basis weight cross direction profile preferably are valves for controlling dilution streams. With aperture-regulated headboxes, the adjusting spindles of the headbox aperture represent these actuators for controlling the basis weight cross direction profile.

In another embodiment of the control process, decoupling of the basis weight cross direction profile and the shrinkage cross direction profile can be carried out in the profile-control algorithm so that the reciprocal influences of the cross direction profile regulations are prevented at least in the first degree. In particular, the smoothness and/or strength of the paper web produced is suitable as a value to be measured, which correlates to the shrinkage and by means of which the shrinkage cross direction profile is indirectly measured or determined. However, other characteristic values of the paper web, which are also accessible to measurement, can be used.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

Other features and advantages of the invention ensue from the subsequent description of preferred exemplary embodiments with reference to the drawings.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for a fundamental understanding of the present invention, the description taken with the drawings making apparent to those skilled in the art how the several forms of the present invention may be embodied in practice.

Figure 1:
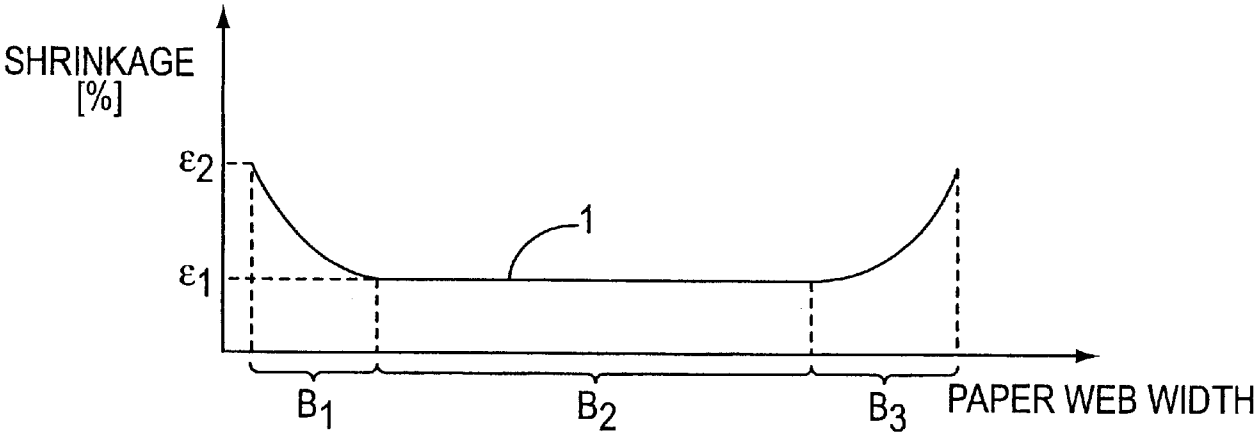
FIG. 1 shows a typical shrinkage cross direction profile of a paper web.

FIG. 1 shows a typical shrinkage cross direction profile 1 of paper webs. The edge regions $B_1$ and $B_3$ are characterized by high shrinkage gradients and high absolute values of the shrinkage $e_2$. In the central region $B_2$, the shrinkage has a relatively low level and extends in a virtually straight and horizontal manner. This shrinkage progression is, in fact, typical for many types of paper, but many other forms of shrinkage cross direction profiles also occur. These depend on many parameters, e.g., the paper type and the process steps in the paper manufacture, e.g., the drying process. For example, shrinkage cross direction profiles with an asymmetrical progression or with a nonlinear progression in the central region $B_2$ of the paper web can also occur.

Figure 2:
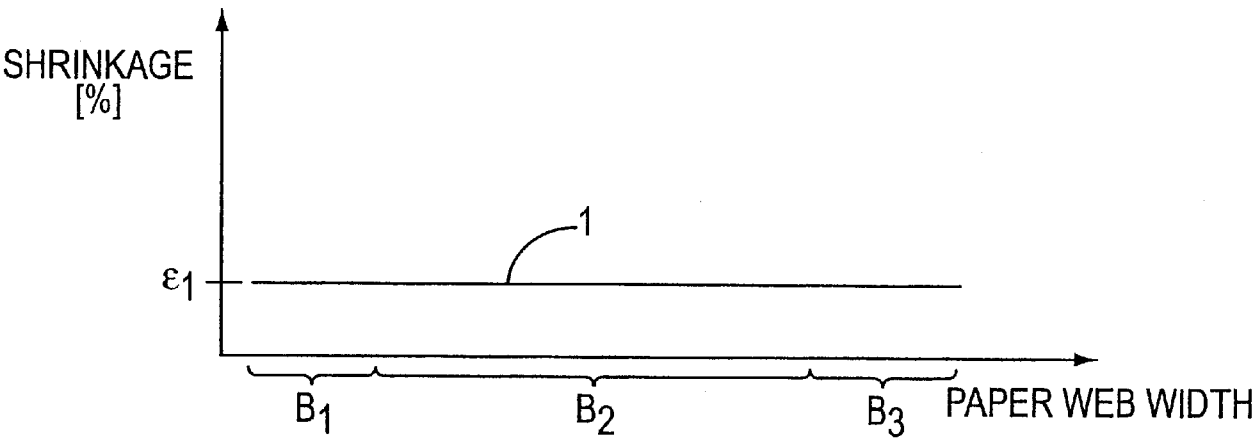
FIG. 2 shows the shrinkage cross direction profile influenced by sectional shrinkage behavior according to the present invention by sectionally changing the composition of the stock suspension.

FIG. 2 shows a shrinkage cross direction profile 1, in which the percentage of fibers that have a lower shrinkage tendency has been increased in the edge regions $B_1$ and $B_3$ or the percentage of fibers with a higher shrinkage tendency has been reduced, while the composition of the stock suspension in the central region $B_2$ of the paper web has remained unchanged. In this connection, in order to achieve as linear as possible a progression of the shrinkage, it may also be necessary to section the edge regions across the width and to execute the influence on the shrinkage using different intensities in the sections.

Figure 3:
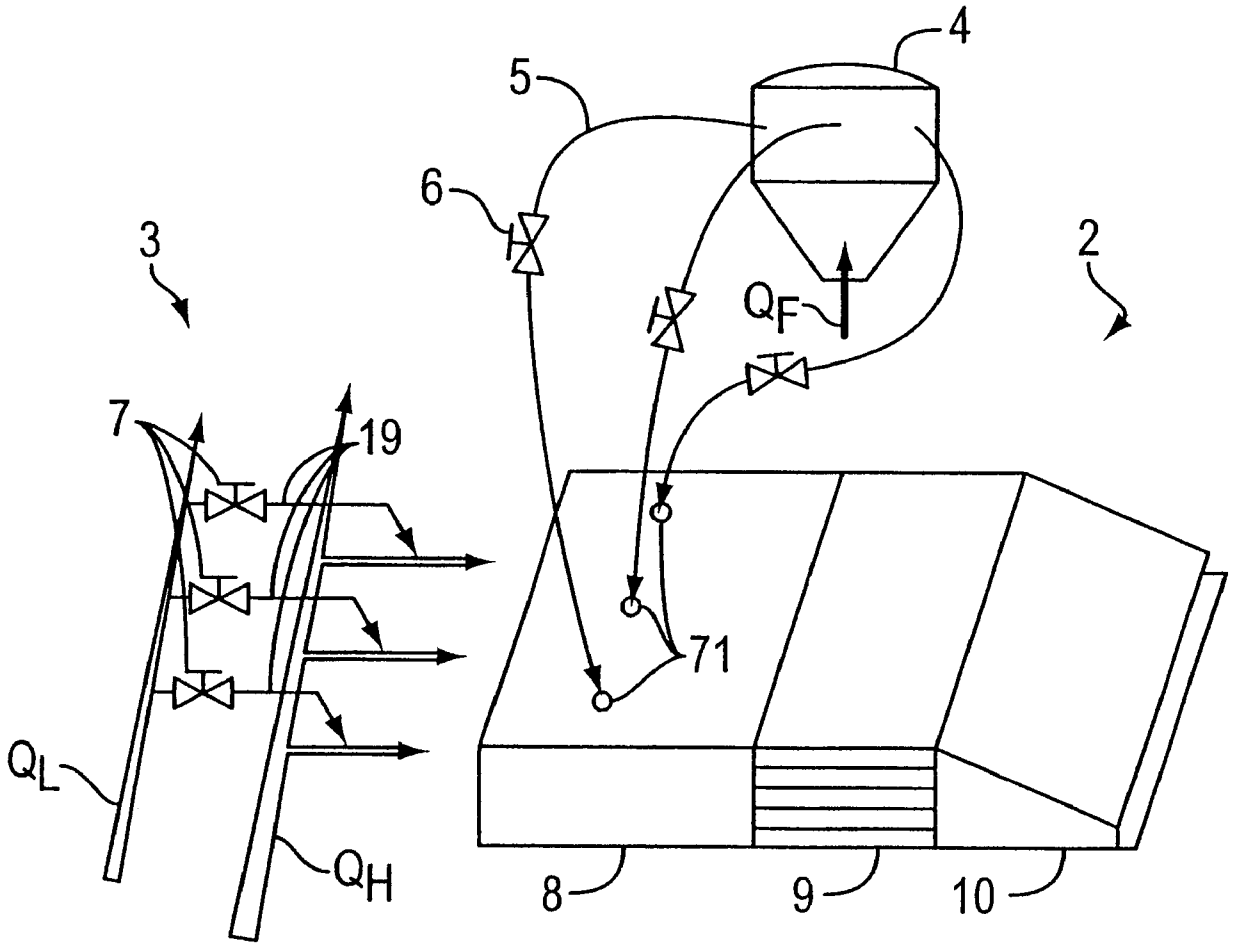
FIG. 3 shows a headbox employing the dilution water principal in accordance with an aspect of the present invention.

By way of example, FIG. 3 shows a headbox 2 according to the dilution water principal for the use of the process according to the invention. In which a container 4 feeds connecting line 5 with the suspension. An exemplary headbox is described, for example, in the above-mentioned German patent application No. DE 40 19 593. In addition to the high-consistency and low-consistency partial flows $Q_H$ and $Q_L$ in a distributor 3, the suspension $Q_F$ is supplied before the turbulence generator at a number of supply points 71 distributed across the width of the headbox. This suspension $Q_F$ contains fibers that differ in their shrinkage behavior from the fibers that are contained in the suspension $Q_H$. For example, if the fibers in $Q_F$ have a lower shrinkage tendency than those in $Q_H$, then the shrinkage cross direction profile 1 shown in FIG. 1 can be improved by virtue of the fact that the sectional volume flow $Q_F$ is increased at the edges.

The supply points 71 for $Q_F$ can be evenly distributed across the width of the headbox or unevenly distributed, for example, only at the edges. The geometry of the supply for $Q_F$ is preferably embodied so that the sectional total volume flow at the outlet of the nozzle remains constant despite variation of $Q_F$. An embodiment of a headbox of this kind is described extensively in DE 42 11 291. Lateral distribution tubes or central distributors can be used to distribute the suspensions across the width of the headbox.

Figure 4:
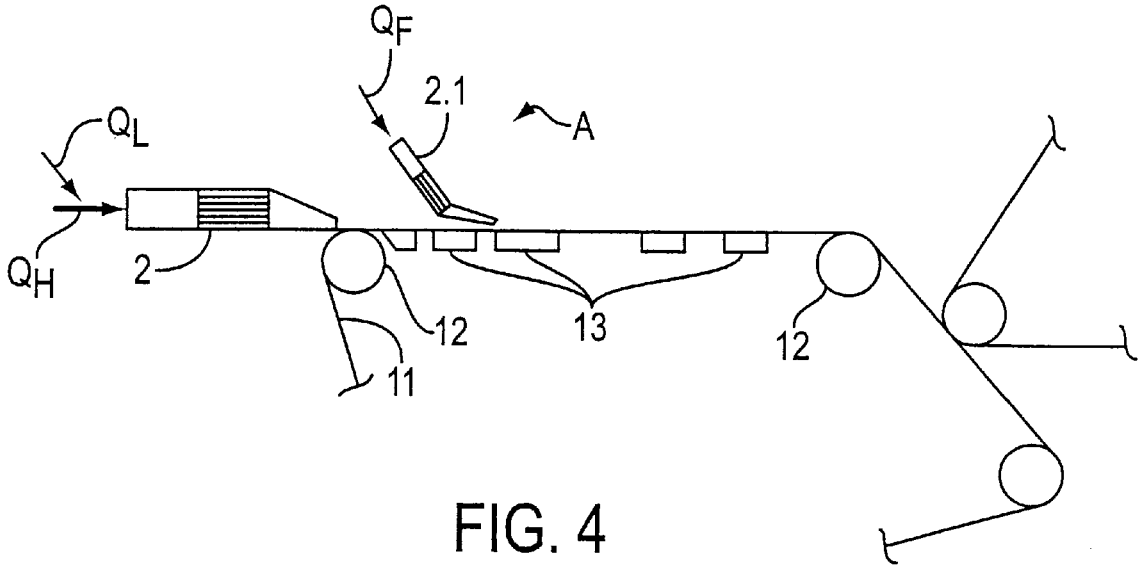
FIG. 4 shows the beginning region of a paper machine with a primary and secondary headbox.

FIG. 4 shows the beginning region of a paper machine with a primary headbox 2, which applies stock suspension to a wire 1 1. The wire 1I1 is deflected by rolls 12 and the drainage of the stock suspension occurs in a known manner by means of drainage elements 13 comprised of suction boxes and drainage strips. After the primary headbox 2, a secondary headbox 2.1 is provided, for applying the stock suspension $Q_F$ in a metered fashion onto the already existing stock suspension layer in sections across the machine width.

Figure 4A:
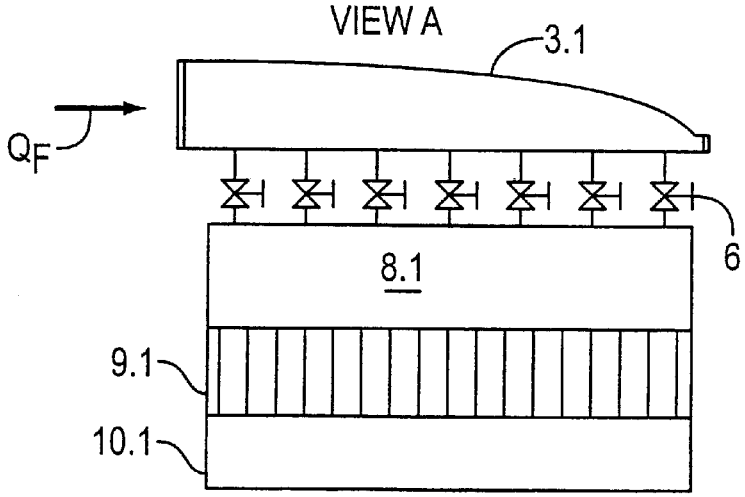
FIG. 4*a* shows view A illustrated in FIG. 4.

FIG. 4*a* shows view A from FIG. 4, in which the secondary headbox 2.1 is depicted. The secondary headbox has a lateral distributor 3.1 that supplies stock suspension $Q_F$ across the machine width to a first chamber 8.1 of the headbox. A plurality of valves 6 are connected between the distributor 3.1 and the first chamber 8.1 of the headbox 2.1 for controlling flow of the suspension $Q_F$ that is metered and is sectioned across the machine width. The first chamber 8.1 of the headbox is followed in known manner by a turbulence generator 9.1 and an adjoining nozzle 10.1.

Figure 5:
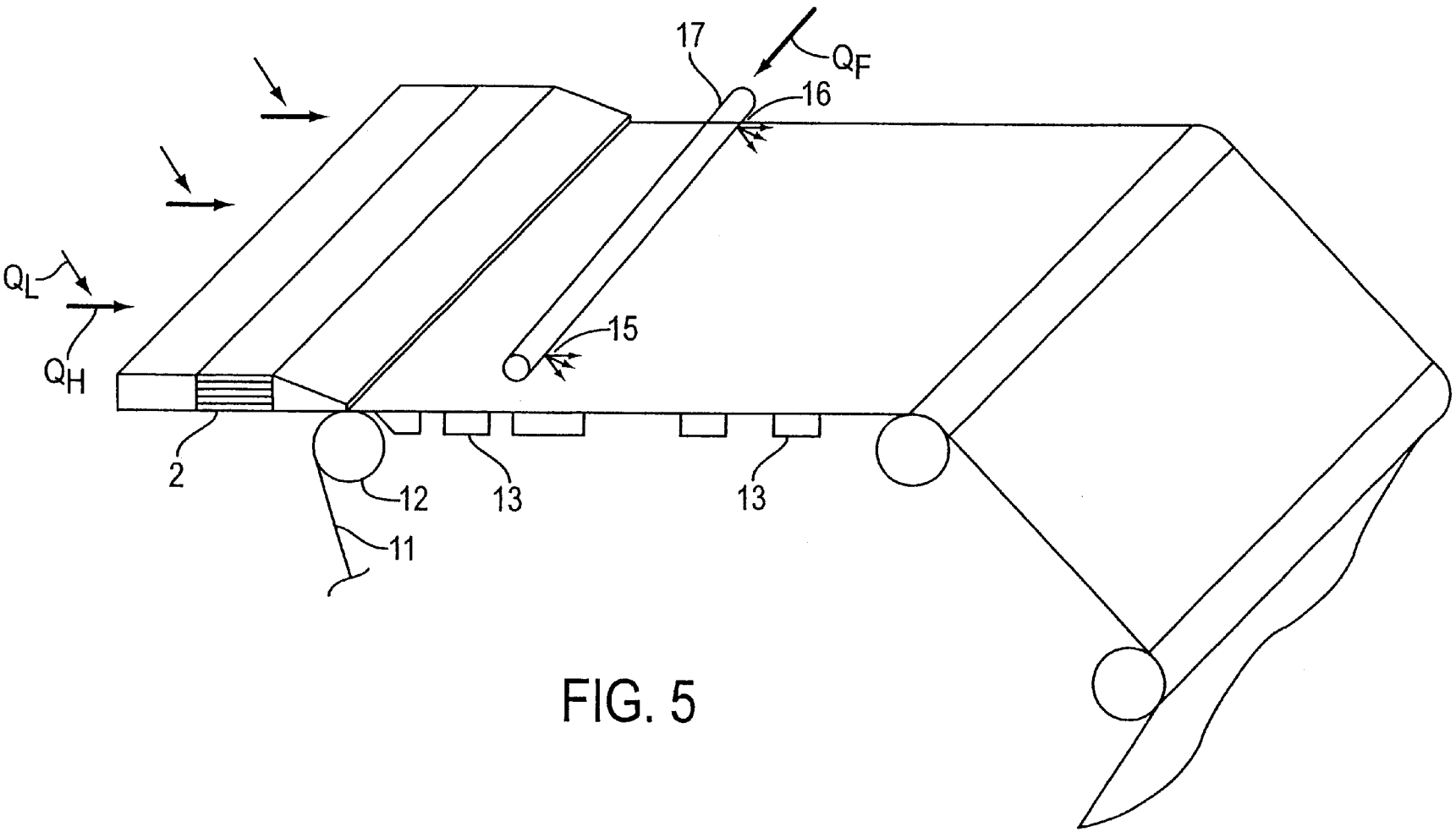
FIG. 5 shows the beginning region of a paper machine including a sprinkler system for applying shrinkage-influencing agents.

FIG. 5 shows a three-dimensional depiction of the beginning of a fourdrinier wire paper machine with a headbox 2, to which the high-consistency and low-consistency stock suspension streams $Q_H$ and $Q_L$ are supplied. The headbox 2 distributes the stock suspension evenly over wire 11. Wire 11 is deflected by a plurality of rolls 12, and drainage elements 13 are provided adjoining the headbox 2 for draining the fibrous material layer lying on the wire 11. Behind the headbox 2 in terms of the machine direction, a sprinkler system 17 is provided, which extends laterally across the machine width. The sprinkler system 17 is supplied with the shrinkage-influencing stock suspension $Q_F$, which according to the present invention, contains a fibrous material mixture that differs with regard to its shrinkage tendency from the fibrous material mixture of the stock suspension $Q_H$. This sprinkler system 17 can also directly supply shrinkage-influencing substances, such as (CMC= carboxymethylcellulose), wet strength additives, or the like. The sprinkler system 17 has a number of spray nozzles 15 and 16 arranged, by way of example here, exclusively at the edges of the paper web, and consequently only spray the edges of the paper web with the suspension $Q_F$. The use of fibers or fiber mixtures not derived from wood, such as plastic fibers, also lies within the scope of the invention.

With the above-described process and the devices shown in the figures, it is now possible to homogenize the shrinkage behavior of a material web across the entire web width when manufacturing a continuous material web of paper or cardboard.

Figure 6:
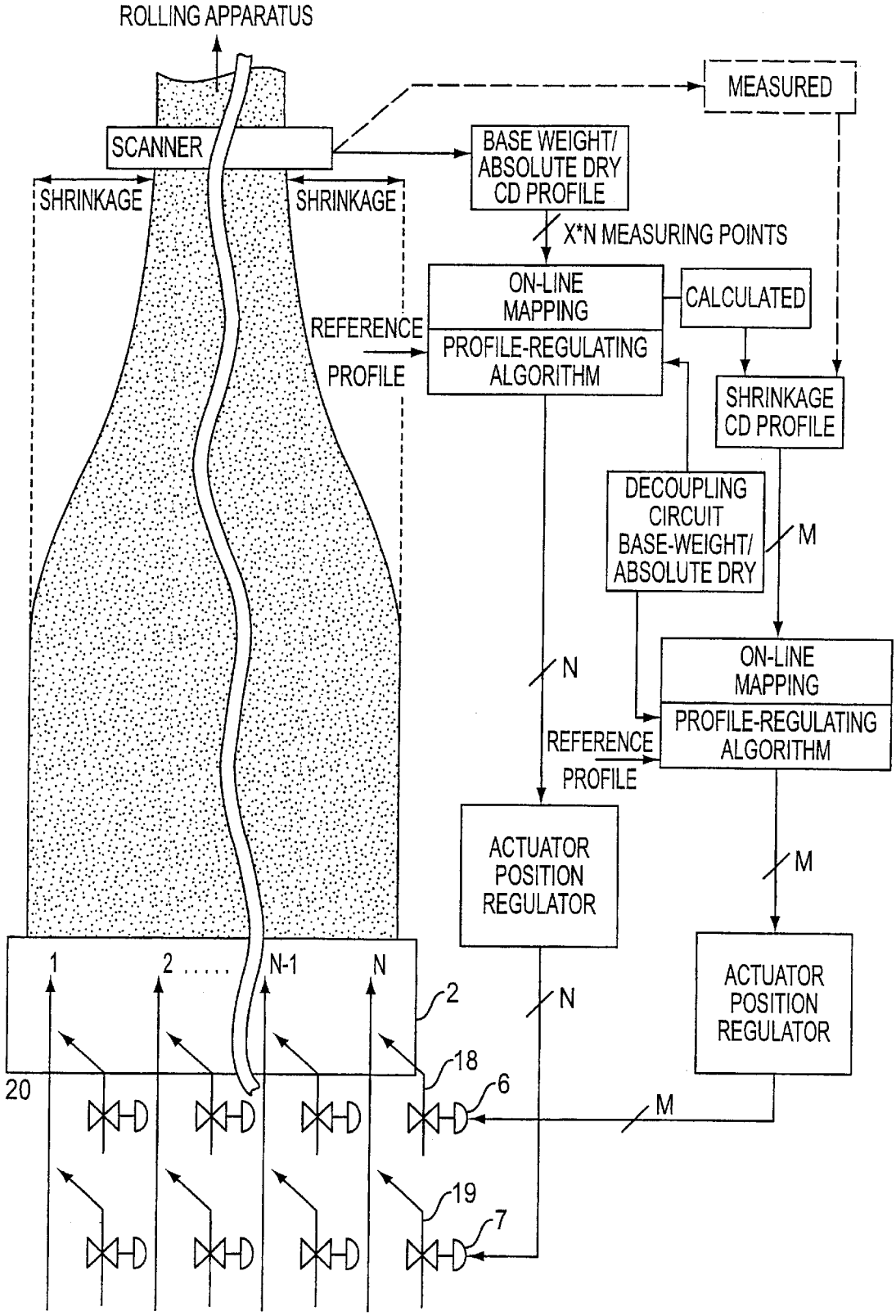
FIG. 6 shows a system for controlling the shrinkage cross direction profile, according to an aspect of the present invention.

FIG. 6 shows an exemplary shrinkage cross direction profile regulation in a paper machine. On the left side is a schematic depiction of the manufacturing path of the paper web, which experiences shrinkage in the course of the manufacturing process and is finally conveyed to a rolling apparatus. The headbox 2 is equipped, by way of example here, with dilution water regulation for adapting the bone dry weight cross direction profile, which is known per se. A scanner as wide as the machine is disposed before the reel and measures the bone dry weight cross direction profile. The scanner supplies information to a profile-control algorithm, and operates actuators which, in this instance, are N valves 7 of the dilution water supply 19 with N sections.

According to the invention, this regulation is extended in that the actual profile of the shrinkage (shrinkage cross direction profile) is calculated by way of an on-line mapping that is known per se and is compared with a target profile for the shrinkage. The profile-control algorithm then determines the necessary corrections and, by means of the actuator position regulator, controls the actuators that influence the shrinkage, which can be embodied as control valves 60 in the M sections of the supply branches of the shrinkage-influencing fluid.

The numbers of the N sections of the dilution regulation and the M sections of the shrinkage regulation are equal in the current example but can also differ. In particular, it can be advantageous to divide the sections for the shrinkage regulation more finely in the edge region of the paper web than in the central region.

As a result of changes in the addition of shrinkage-influencing suspensions, the basis weight profile inevitably also changes. Because these changes can be predetermined with regard to their section as well as their size, compensation for the expected basis weight error can be carried out in a preliminary process. The same principle can also be used in reverse. In FIG. 6, this compensation possibility is represented by the decoupling circuit between the two profile control circuits. In this manner, a large degree of independence is produced between the basis weight regulation and the shrinkage regulation.

In addition, FIG. 6 also shows with dashed lines a possibility of indirectly measuring the shrinkage cross direction profile by measuring a value that correlates to the shrinkage. For example, the smoothness/surface roughness and/or the strength of the paper web can be measured. In the control process, this measured profile can be used directly by itself or in combination with the calculated shrinkage profile. If both profiles are used for the regulation, then the control mechanism can be optimized.

According to the present invention, a paper machine includes an approach flow system, a headbox with at least one stock suspension supply 20 from the approach flow system, a wet section, a press section, and a drying section. The approach flow system has at least two regions that produce different stock suspensions with fiber mixtures having different shrinkage behaviors. The stock suspension supplied from the approach flow system to the headbox have at least two branches for the at least two different stock suspensions, and near the headbox, a plurality of sectional mixing points are provided to combine the stock suspensions having different shrinkage properties. As discussed above, the different fiber mixtures for the stock suspension can be produced from fibrous material with either longer or shorter fibers, and/or more or less re-pulped fibers, and/or more or less beaten fibers and/or shrinkage-influencing materials. Depending on their processing and/or structure and/or their parent material, these fibers produce a different shrinkage behavior, enabling uniform shrinkage behavior of the material web across the entire web width.

It is noted that the foregoing examples have been provided merely for the purpose of explanation and are in no way to be construed as limiting of the present invention. While the present invention has been described with reference to an exemplary embodiment, it is understood that the words that have been used herein are words of description and illustration, rather than words of limitation. Changes may be made, within the purview of the appended claims, as presently stated and as amended, without departing from the scope and spirit of the present invention in its aspects. Although the present invention has been described with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for homogenizing the cross direction profile of a continuous web comprising:

producing at least one machine width stock suspension layer on a wire or between two wires;

controlling the local composition of the stock suspension sectionally across the width by changing the proportions of components with different shrinkage behaviors so that the shrinkage cross direction profile of the material web is homogenized during its manufacturing process; and draining, pressing, and drying the material web produced from the stock suspension layer.

2. The process according to claim 1, further comprising increasing supply of fibers and/or other materials having an increased shrinkage tendency to produce an intensification of the shrinkage of a sectional region.

3. The process according to claim 1, further comprising replacing fibers with a reduced shrinkage tendency with fibers and/or other materials having an increased shrinkage tendency to produce an intensification of the shrinkage of a sectional region.

4. The process according to claim 1, further comprising increasing a supply of fibers and/or other materials having a reduced shrinkage tendency to reduce the shrinkage of a sectional region.

5. The process according to claim 1, further comprising replacing fibers having an increased shrinkage tendency with fibers and/or other materials having a reduced shrinkage tendency to reduce the shrinkage of a sectional region.

6. The process according to claim 1, further comprising metering desired fibers and/or other materials in a headbox and/or in a wet section.

7. The process according to claim 1, further comprising producing, in an approach flow system of the paper or cardboard machine, at least two stock suspension streams with fibers and/or other materials having different shrinkage behaviors;

sectionally mixing at least two stock suspension streams with fibers and/or other materials that have different shrinkage tendencies in the region of the headbox so that the shrinkage of the material web across the machine width is balanced; and sectionally metering dilution water to control a basis weight cross direction profile and/or the fiber orientation cross direction profile.

8. The process according to claim 2, in which the fibers having an increased shrinkage tendency comprise long fibers.

9. The process according to claim 2, in which the fibers having an increased shrinkage tendency comprise highly re-pulped fibers.

10. The process according to claim 2, in which the fibers having an increased shrinkage tendency comprise more highly beaten fibers.

11. The process according to claim 1, further comprising increasing shrinkage by using carboxymethylcellulose (CMC) and/or other materials as agents, and inhibiting shrinkage by using artificial resins and/or wet strength agents and/or other materials as agents.

12. The process according to claim 2, in which the fibers having a reduced shrinkage tendency comprise short fibers.

13. The process according to claim 2, in which the fibers having a reduced shrinkage tendency comprise slightly re-pulped fibers.

14. The process according to claim 2, in which the fibers having a reduced shrinkage tendency comprise slightly beaten fibers.

15. A process for controlling the shrinkage cross direction profile of a continuous web made of paper or cardboard, comprising:

measuring the basis weight cross direction profile of the material web;

determining control variables for adapting the basis weight in at least one section across the machine width in conjunction with a reference profile for the basis weight;

operating actuators for adapting the basis weight cross direction profile;

calculating the shrinkage cross direction profile by on-line mapping of the basis weight cross direction profile;

determining control variables for controlling the shrinkage in at least one section across the machine width in conjunction with a reference profile for the shrinkage; and operating actuators for adapting the shrinkage cross direction profile.

16. The process according to claim 15, further comprising:

measuring a value that correlates to the shrinkage;

calculating the shrinkage cross direction profile by correlating between the measured value and the shrinkage;

determining control variables for influencing the shrinkage in the at least one section across the machine width in conjunction with a reference profile for the shrinkage; and operating actuators for adapting the shrinkage cross direction profile.

17. The process according to claim 15, further comprising:

calculating the shrinkage cross direction profile by on-line mapping of the basis weight cross direction profile and additionally measuring a value that correlates to the shrinkage;

correlating the measured value and the shrinkage to calculate the shrinkage cross direction profile;

determining a weighted shrinkage cross direction profile from the measured shrinkage cross direction profile and the calculated cross direction profile;

determining control variables for influencing the shrinkage in the at least one section across the machine width in conjunction with a reference profile for the shrinkage; and operating actuators for adapting the shrinkage cross direction profile.

18. The process according to claim 15, wherein decoupling is carried out between the basis weight cross direction profile and the shrinkage cross direction profile in the profile-control algorithm.

19. A process for controlling the shrinkage cross direction profile of a continuous web made of paper or cardboard, comprising:

measuring the basis weight cross direction profile of the material web;

determining control variables for adapting the basis weight in at least one section across the machine width in conjunction with a reference profile for the basis weight;

operating actuators for adapting the basis weight cross direction profile;

calculating the shrinkage cross direction profile by on-line mapping of the basis weight cross direction profile;

determining control variables for controlling the shrinkage in at least one section across the machine width in conjunction with a reference profile for the shrinkage; and operating actuators for adapting the shrinkage cross direction profile, wherein the adaptation of the shrinkage cross direction profile occurs by the process according to claim 1.

20. A process for controlling the shrinkage cross direction profile of a continuous web made of paper or cardboard, comprising:

measuring the basis weight cross direction profile of the material web;

determining control variables for adapting the basis weight in at least one section across the machine width in conjunction with a reference profile for the basis weight;

operating actuators for adapting the basis weight cross direction profile;

calculating the shrinkage cross direction profile by on-line mapping of the basis weight cross direction profile;

determining control variables for controlling the shrinkage in at least one section across the machine width in conjunction with a reference profile for the shrinkage;

operating actuators for adapting the shrinkage cross direction profile.

measuring a value that correlates to the shrinkage;

calculating the shrinkage cross direction profile by correlating between the measured value and the shrinkage;

determining control variables for influencing the shrinkage in the at least one section across the machine width in conjunction with a reference profile for the shrinkage; and operating actuators for adapting the shrinkage cross direction profile, wherein at least one of smoothness and the strength is the measured value that correlates to the shrinkage.

21. Paper produced according to the process of claim 1.

* * * * *